US008104885B2

(12) United States Patent
Balcan

(10) Patent No.: US 8,104,885 B2
(45) Date of Patent: Jan. 31, 2012

(54) SELECTOR FOR ENGAGEMENT OF PRINTER FUNCTIONS

(75) Inventor: Petrica D. Balcan, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 1035 days.

(21) Appl. No.: 11/969,277

(22) Filed: Jan. 4, 2008

(65) Prior Publication Data

US 2009/0174733 A1 Jul. 9, 2009

(51) Int. Cl.
*B41J 2/01* (2006.01)

(52) U.S. Cl. ..... 347/104; 347/101

(58) Field of Classification Search ..... None
See application file for complete search history.

(56) References Cited

U.S. PATENT DOCUMENTS

| | | | | |
|---|---|---|---|---|
| 5,704,606 | A * | 1/1998 | Kim | 271/10.13 |
| 6,334,725 | B1 * | 1/2002 | Miyauchi | 400/624 |
| 6,846,060 | B2 | 1/2005 | Waller et al. | |
| 7,225,697 | B2 | 6/2007 | Schalk et al. | |
| 2004/0196327 | A1 | 10/2004 | Nishioka | |
| 2004/0212654 | A1 | 10/2004 | Waller | |

FOREIGN PATENT DOCUMENTS

| | | |
|---|---|---|
| EP | 1 769 931 | 4/2007 |

* cited by examiner

*Primary Examiner* — Matthew Luu
*Assistant Examiner* — Kendrick Liu
(74) *Attorney, Agent, or Firm* — William R. Zimmerli; Peyton C. Watkins

(57) ABSTRACT

An apparatus and method of driving multiple printer functions using the same motor is provided. The method includes providing a motor; providing a selector pin; providing a cam member assembly including a cam member including a plurality of paths, each path corresponding to a printer function; and relatively moving the cam member and the selector pin through the plurality of paths to selectively permit the motor to drive the corresponding printer function.

10 Claims, 8 Drawing Sheets

SELECTOR FOR ENGAGEMENT OF PRINTER FUNCTIONS

FIELD OF THE INVENTION

The invention relates generally to the field of inkjet printers, and in particular to a mechanical device that enables selective engagement of one or more of a plurality of operational modes of the printer, where each mode is driven by the same motor.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink chamber, an ejecting actuator and an orifice through which droplets of ink are ejected. The ejecting actuator may be one of various types, including a heater that vaporizes some of the ink in the chamber in order to propel a droplet out of the orifice, or a piezoelectric device which changes the wall geometry of the chamber in order to generate a pressure wave that ejects a droplet. The droplets are typically directed toward paper or other print medium (sometimes generically referred to as paper herein) in order to produce an image according to image data that is converted into electronic firing pulses for the drop ejectors as the print medium is moved relative to the printhead.

Motion of the print medium relative to the printhead may consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads. A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath. In order to accomplish the motions necessary for printing in a carriage printer, there are typically at least two motors—the motor for print medium advance, and the motor for carriage motion. The examples described in the present invention relate to a carriage printer architecture.

As carriage printer technology matures, there is a need to offer more functions and at lower cost. While previous printers may have dedicated a separate motor (in addition to the motor for paper advance and the motor for carriage motion) to drive an additional function, offering the function without the need for an additional motor is desirable.

It is known in the prior art to use the power of the paper advance motor to operate the various functions of the maintenance station in an inkjet printer. U.S. Pat. Nos. 6,846,060 and 7,225,697, for example, describe power transmission mechanisms that are selectively engaged or disengaged depending on whether or not the carriage is parked at the maintenance station. If the carriage is parked at the maintenance station, a feature on the carriage enables the power transmission mechanism to be engaged. By this means, the maintenance station functions including wiping and capping may be powered by the paper advance motor. When the carriage moves away from the maintenance station, the feature on the carriage no longer enables the power transmission to be engaged for maintenance operations, so that the paper advance motor is used for moving paper through the printer.

For some modes of printing, it is necessary to operate different paper advancing rollers at different times or in different directions. In such a case, a mechanism such as those in '060 and '697 which only allows engagement when the carriage and printhead are parked at the maintenance station is not sufficient.

There is a need, therefore, for a selector mechanism that can operate in different selection positions even after the carriage has moved away, and that can selectively engage one or more of a plurality of functions, driven selectively by a single motor.

SUMMARY OF THE INVENTION

According to one feature of the present invention, a printer includes a selector pin and a cam member. The cam member includes a plurality of paths with each path corresponding to a printer function. The cam member and the selector pin are configured to provide relative movement of the selector pin through the plurality of paths with the location of the selector pin in one of the plurality of paths enabling the corresponding printer function.

According to another feature of the present invention, a method of driving multiple printer functions using the same motor includes providing a motor; providing a selector pin; providing a cam member assembly including a cam member including a plurality of paths, each path corresponding to a printer function; and relatively moving the cam member and the selector pin through the plurality of paths to selectively permit the motor to drive the corresponding printer function.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

In the following description of preferred embodiments, directional terminology such as front, rear, left, right, top, bottom, etc. is used with reference to the orientation of the figure being described or to the orientation of a component when it is located in its normal operating position in the example being described. Because components of the embodiments of the present invention can be positioned in a number of different orientations, the directional terminology is used for purposes of illustration and is in no way limiting.

Figure 1:
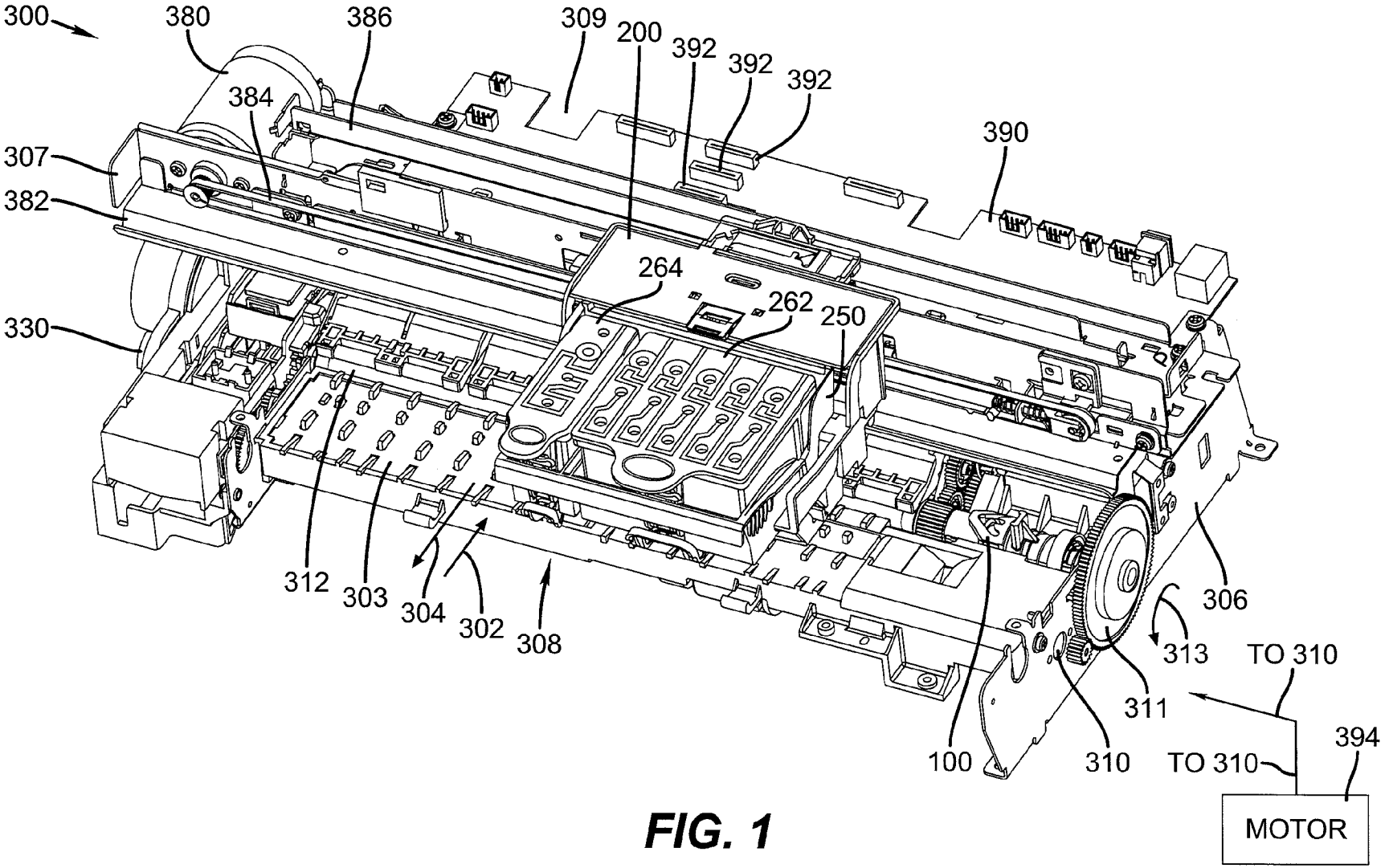
FIG. 1 is a perspective illustration of a printer including an embodiment of the present invention.

FIG. 1 shows a portion of a carriage printer that includes an embodiment of the present invention. Printer chassis 300 has a print region 303 across which carriage 200 is moved back and forth between the right side 306 and the left side 307 of printer chassis 300 while printing. Carriage motor 380 moves belt 384 to move carriage 200 back and forth along carriage guide rail 382. Printhead chassis 250 is mounted in carriage 200, and ink supplies 262 and 264 are mounted in the printhead chassis 250. Paper, or other print media is loaded along paper load entry direction 302 toward the front 308 of printer chassis 300. A variety of rollers are used to advance the medium through the printer, as shown schematically in the side view of FIG. 2.

Figure 2:
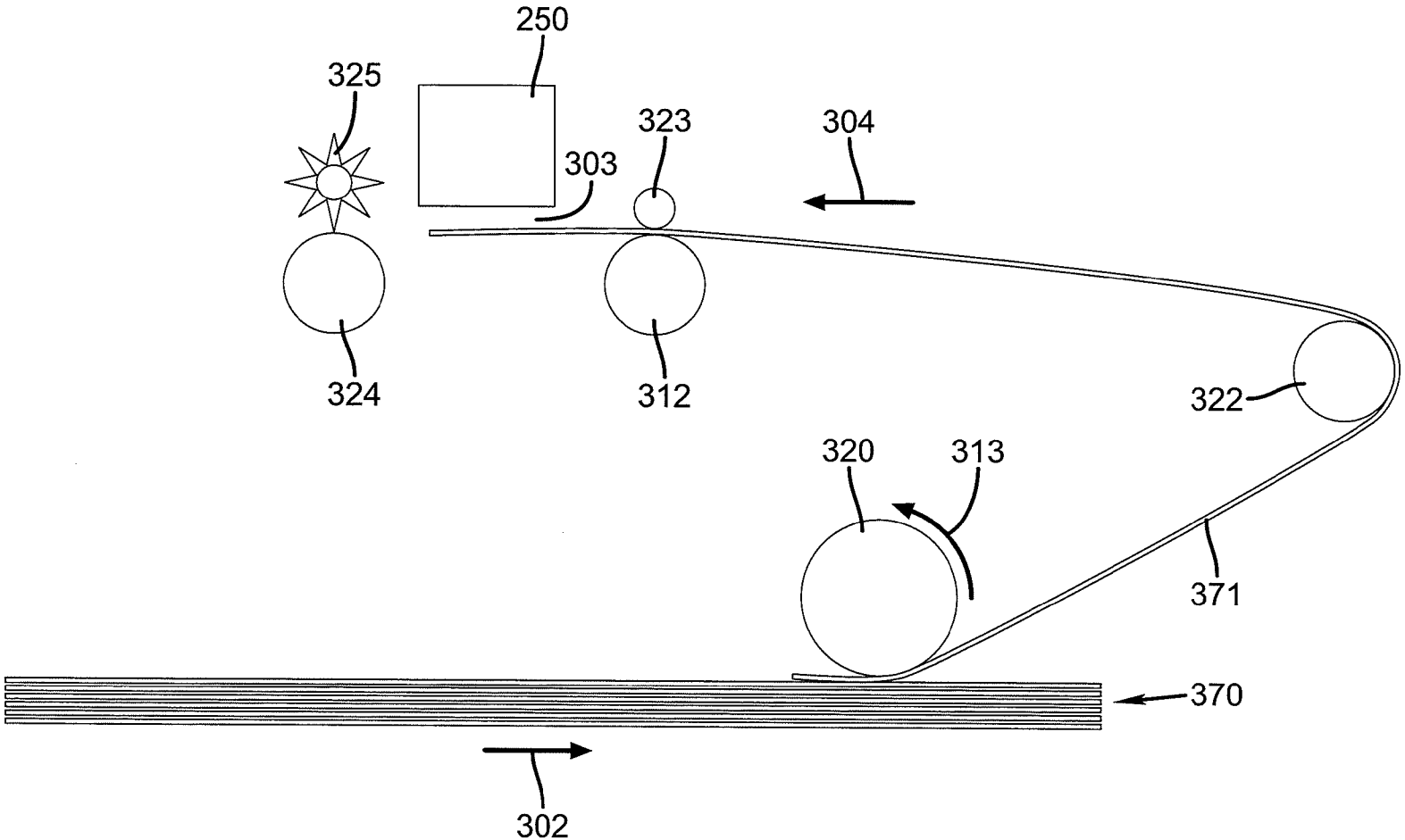
FIG. 2 is a schematic side view showing paper being advanced through the printer.

In FIG. 2, a pickup roller 320 moves the top sheet 371 of a stack 370 of paper or other media in the direction of arrow 302. A turn roller 322 toward the rear 309 of the printer chassis 300 acts to move the paper around a C-shaped path (in cooperation with a curved rear wall surface) so that the paper continues to advance along direction arrow 304 from the rear 309 of the printer. The paper is then moved by feed roller 312 and idler roller(s) 323 to advance across print region 303, and from there to a discharge roller 324 and star wheel(s) 325 so that printed paper exits along direction 304. Feed roller 312 includes a feed roller shaft 319 along its axis, and feed roller gear 311 is mounted on the feed roller shaft 319. Feed roller 312 may consist of a separate roller mounted on feed roller shaft 319, or may consist of a thin high friction coating on feed roller shaft 319.

Referring back to FIG. 1, selector assembly 100 is mounted in association with feed roller shaft 319, and is near feed roller gear 311. The motor 394 that powers the paper advance rollers is shown schematically in FIG. 1. Hole 310 at the right side 306 of the printer chassis 300 is where the motor gear (not shown) protrudes through in order to engage feed roller gear 311, as well as the gear for the discharge roller (not shown). For normal paper pick-up and feeding, it is desired that all rollers rotate in forward direction 313. Toward the left side 307 in the example of FIG. 1 (and near the end of the feed roller 312 that is opposite the end where feed roller gear 311 is mounted) is the maintenance station 330. Toward the rear 309 of the printer in this example is located the electronics board 390, which contains cable connectors 392 for communicating via cables (not shown) to the printhead carriage 200 and from there to the printhead. Also on the electronics board are typically mounted motor controllers for the carriage motor 380 and for the paper advance motor, a processor and/or other control electronics for controlling the printing process, and an optional connector for a cable to a host computer.

Figure 3:
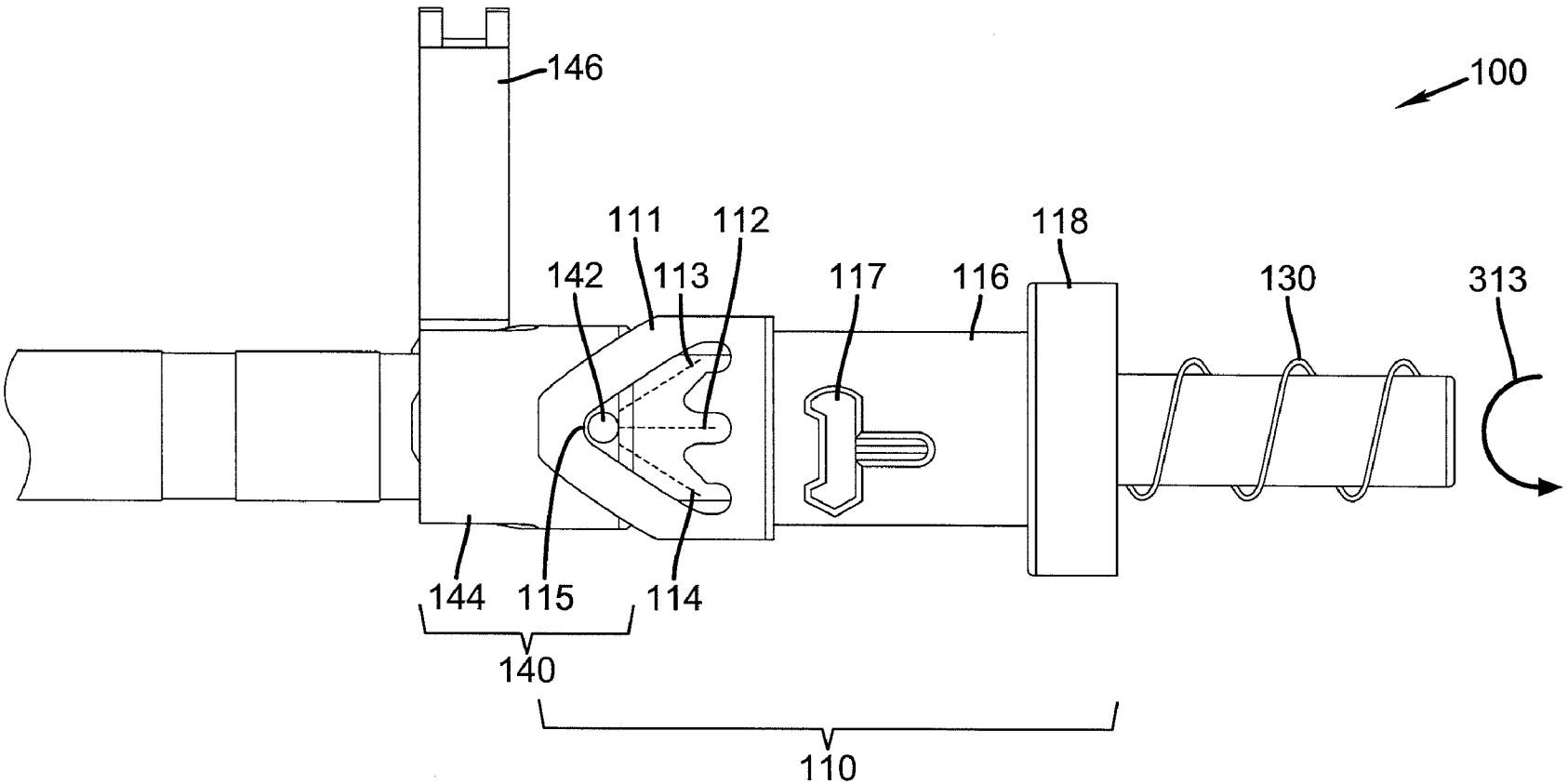
FIG. 3 is a top view of an embodiment of the selector assembly of the present invention.
Figure 4:
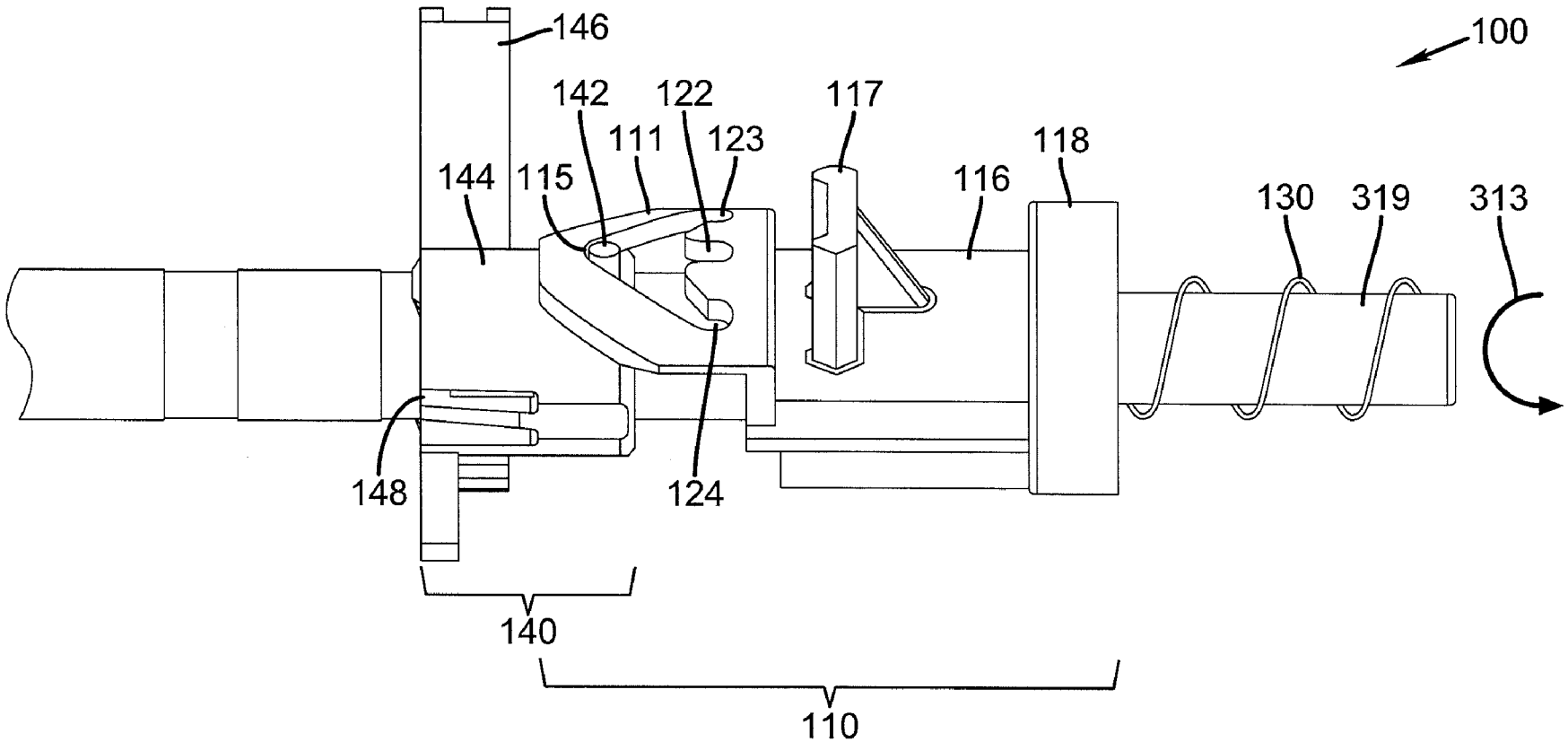
FIG. 4 is a perspective view of an embodiment of the selector assembly of the present invention.

FIG. 3 shows a top view and FIG. 4 shows a perspective view of a first embodiment of the selector assembly 100 of this invention. Selector assembly 100 includes a cam member assembly 110, a spring 130 and a selector pin assembly 140 that are each coaxially mounted on the feed roller shaft 319 in this embodiment. Cam member assembly 110 includes a cam member 111 which includes a first cam path 112, a second cam path 113, a third cam path 114 (cam paths indicated as dotted lines in FIG. 3), and a stop position 115; a sleeve 116; a pushing feature 117; and a flange 118. Cam member assembly 110 can optionally be made as an integrally formed part, for example by injection molding. One end of each cam path is the stop position 115, while the other end of the three cam paths are slots 122, 123 and 124 respectively. Spring 130 is positioned toward the end of the feed roller shaft 319 and is adjacent to flange 118 of cam member assembly 110. Optionally the flange 118 may have an internal recess inside of which one end of spring 130 is retained. The other end of spring 130 is positioned against a wall at the right side 306 of printer chassis 300.

On the other side of cam assembly 110, the selector pin assembly 140 is mounted. Selector pin assembly 140, which optionally may be made as an integrally formed part (for example, by injection molding), includes selector pin 142 extending radially outwardly from friction mount sleeve 144, and arm(s) 146 also extending outwardly from friction mount sleeve 144. Cam member 111 cantilevers over friction mount sleeve 144, such that selector pin 142 is captured within the open area of cam member 111, and extends through it, as seen more clearly in FIG. 4. Selector pin 142 is sized to fit into each of slots 122, 123 and 124, as well as into stop position 115.

Also shown in FIG. 4 are slots 148 in friction mount sleeve 144, which functions as a type of clutch mechanism. The fit of friction mount sleeve 144 on feed roller shaft 319 is sufficiently close that friction mount sleeve 144 will rotate when feed roller shaft 319 rotates, but it is loose enough that friction mount 144 can be rotated independently of feed roller shaft 319. The fit of sleeve 116 of cam assembly 110 is loose enough, or cam assembly 110 is optionally constrained rotationally, so that cam assembly 110 does not rotate significantly when feed roller shaft 319 rotates. Friction mount sleeve 144 is constrained translationally along feed roller shaft 319, so that it may not be moved back and forth significantly along the shaft. Cam assembly 110 is free to move back and forth along feed roller shaft 319, but is biased toward selector pin assembly 140 by spring 130.

Next the operation of the selector assembly 110 will be explained. Spring 130 tends to push cam assembly 110 toward selector pin assembly 140, so that selector pin 142 is normally located in one of the three slots 122, 123 or 124. However, if carriage 200 is moved sufficiently toward the right side 306 of printer chassis 300 in this example, a feature (not shown) on carriage 200 hits pushing feature 117, causing cam assembly 110 to move toward the right and compress spring 130. As this happens, the selector pin 142 will move relative to the cam member 111 along the cam path 112, 113 or 114 to stop position 115 from the slot (122, 123 or 124 respectively) that it had been in. If the pin had been in slot middle slot 122, no rotation of selector pin assembly 140 occurs during this operation. However, if the pin had been in either slot 123 or 124, the interaction of pin 142 and the outside cam surfaces of cam member 111 will cause selector pin assembly 140 (including arm 146) to rotate relative to the feed roller shaft 319. If the carriage 200 is moved to the left in this example, spring 130 pushes cam assembly 110 toward selector pin assembly 140 so that selector pin 142 moves along one of the cam paths 112, 113 or 114, the particular path depending upon whether the feed roller 312 is rotated as carriage 200 moves to the left. If feed roller 312 is not rotated, then selector pin 142 moves parallel to the axis of the feed roller shaft 319 along path 112 into slot 122. If the media advance motor turns feed roller 312 in forward rotation direction 313, friction mount sleeve 144 will cause selector pin assembly 140 to rotate in direction 313, while cam assembly 110 does not rotate, so that selector pin 142 moves along cam path 114 to slot 124. If the media advance motor turns feed roller 312 in reverse, friction mount sleeve 144 will cause selector pin assembly 140 to rotate in reverse, while cam assembly 110 does not rotate, so that selector pin 142 moves along cam path 113 to slot 123. Selector pin 142 is held in whichever slot it was moved to until carriage 200 is moved back at some later time and pushes the pushing feature 117 so that the selector pin is moved to its location at the stop position 115, and can then be moved to a different slot if desired. Different slots may be reached from the intermediate location by the selector pin 142 following different cam paths. While in the present example, the intermediate location is defined by stop position 115 beyond which selector pin 142 can not move, in other embodiments the intermediate location does not need to occur at a stop position.

As selector pin assembly 140 is rotated and held in different positions corresponding to slots 122, 123 or 124, arm 146 rotates correspondingly. There are a variety of possible gear engagement/disengagement possibilities that the selector pin assembly 100 of the present invention may enable. In one embodiment of this invention, arm 146 is configured to interact with different gears or gear assemblies, selectively enabling or disabling power transmission from the media feed motor, depending upon its rotational position around feed roller shaft 319. For example, in one rotational position, a surface of arm 146 may prevent a pivoting gear assembly from rotating into engagement with another gear assembly, while in another rotational position of arm 146, that pivoting gear assembly is free to rotate into engagement with a first gear or a second gear, depending upon the direction of rotation of feed roller shaft 319. In another embodiment, in one rotational position an arm may push a gear out of engagement with another gear, while in another rotational position, an arm 146 (the same arm, or a different arm, or a different surface of the same arm) may push a gear into engagement with another gear, regardless of direction of rotation of the feed roller shaft. In still another embodiment, a gear that is driven by the media advance motor may be mounted on arm 146 and rotated into or out of engagement with other gears.

Once the carriage 200 has enabled the changing of power transmission engagement in this invention, the carriage is free to move away from the selector assembly 100. This means that different operational modes of printing can be selectively enabled by selector assembly 100 of the present invention. Furthermore, in this embodiment, three separate power transmission engagements are possible (corresponding to selector pin being in either slot 122, 123 or 124), rather than just two. In other embodiments there can be even more individually selectable power transmission engagements, by designing a cam member 111 having more than three branches of cam paths. In fact, it is also possible to have a translational motion of the selector pin assembly 140 along feed roller shaft 319, so that arm 146 enables a different gear engagement when selector pin 142 is in the stop position 115 than when the selector pin is in slot 122. In such an embodiment, four different power transmission engagements could be enabled by the selector assembly 100 shown in FIGS. 3 and 4.

A variety of printer functions may be selectively enabled using selector assembly 100. In one embodiment of this invention, a pick function is enabled with selector pin 142 in slot 124, a printing function is enabled with selector pin 142 in slot 122, and a photo tray movement function is enabled with selector pin 142 in slot 123. In the pick function forward mode, power from the media advance motor is transmitted to all four of the rollers shown schematically in FIG. 2, i.e. pick roller 320, turn roller 322, feed roller 312, and discharge roller 324 and causes them to rotate in forward direction 313. Thus, the pick roller 320 advances the top sheet 371 to the turn roller 322, the turn roller 322 advances the sheet to the feed roller 312, and the feed roller advances the sheet to the discharge roller 324 when the motor rotates such that the four rollers rotate in forward direction 313.

Figure 5:
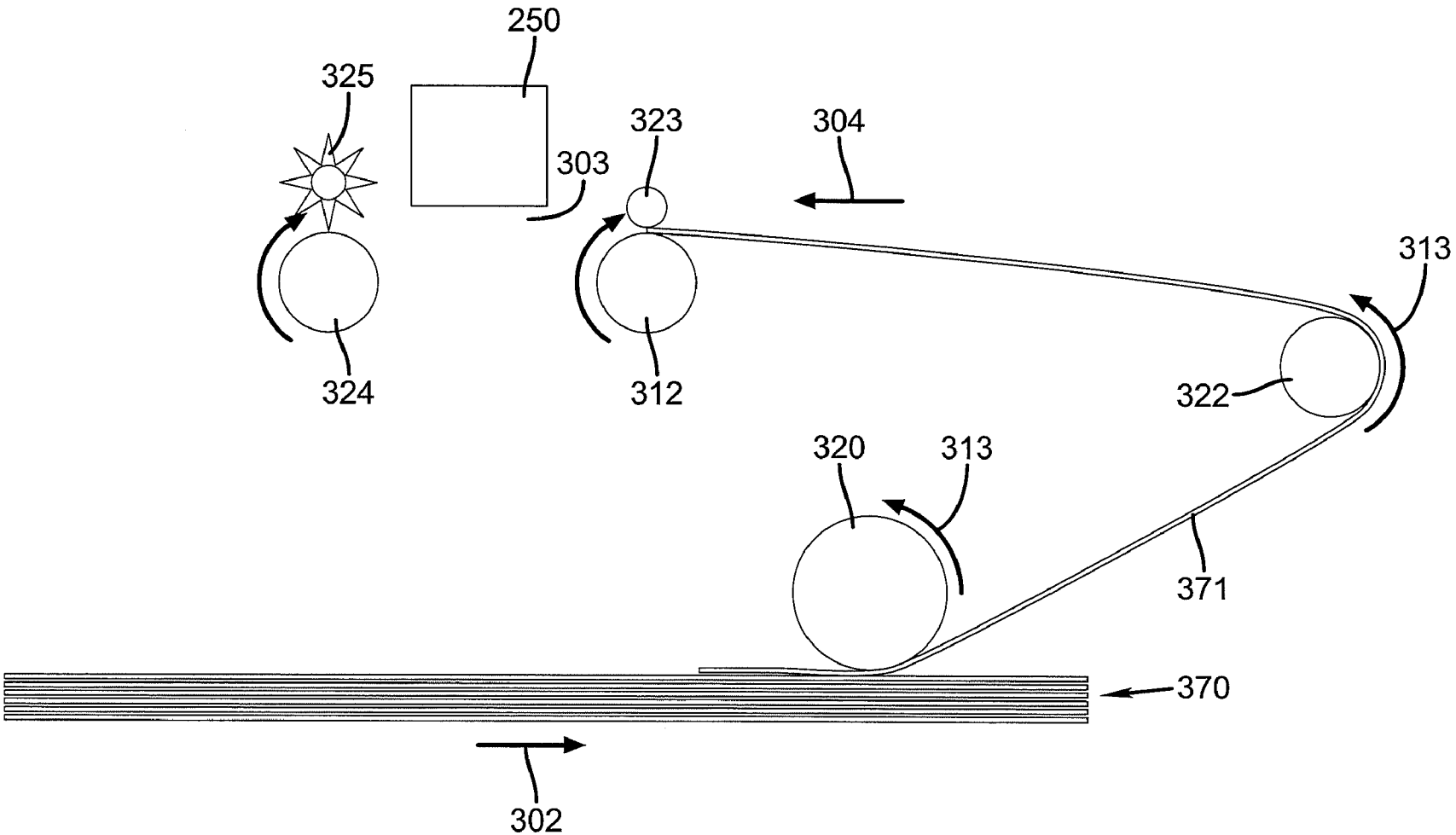
FIG. 5 is a schematic side view showing paper being advanced in a deskew mode.

The pick function has a second mode called the deskew mode, which is enabled with selector pin 142 in slot 122, but with the media advance motor rotating in reverse. The deskew mode may be useful for certain types of jobs, such as printing photos on 4"×6" photo papers. The roller motion in deskew mode is indicated in FIG. 5. With reference to FIG. 1, the gear from the media advance motor that extends through hole 310 is always engaged with feed roller gear 311 and the discharge roller gear (not shown). Thus when the motor rotates in reverse, both the feed roller 312 and the discharge roller 324 rotate in reverse direction (opposite 313). However, in an embodiment of this invention, the pick roller 320 and the turn roller 322 are each connected to power transmission through pivoting gear assemblies, such that even if the motor turns in reverse, the pick roller 320 and the turn roller 322 continue to move in forward direction 313. Thus, in the deskew mode, the pick roller 320 and the turn roller 322 advance the paper toward the feed roller 312, but the feed roller 312 is rotating in reverse and resists forward movement of the paper. If the paper is misoriented such that its leading edge is not parallel with the feed roller 312, the first portion of the leading edge that hits reversely spinning feed roller 312 is slowed down until the rest of the leading edge can catch up, thus deskewing the paper. When deskewing is completed, the carriage 200 is again moved to the right such that the pushing feature 117 is pushed and the selector pin 142 moves to the stop position 115. With the feed roller 312 stationary, the carriage 200 moves to the left, such that the selector pin moves to slot 122 to enable the printing function mode.

In the printing function mode, power from the media advance motor is transmitted to forwardly rotate the turn roller 322, the feed roller 312 and the discharge roller 324, but no power is transmitted to the pick roller 320. Thus in the printing mode, with the pick roller 320 disabled, printing media can continue to advance through the printer without the pick roller 320 advancing a next sheet until needed. If the deskew mode of paper advance is being used, then the next sheet cannot be advanced to feed roller 312 until the previous sheet has been discharged, because the deskew mode operates the feed roller 312 and the discharge roller 324 in reverse.

However, in the pick function forward mode (also called the "tailgating mode") described above, one sheet can immediately follow the next, with no gap between the two sheets. Thus when deskew is not required, the faster printing throughput tailgating mode is used. The tailgating mode begins with the selector pin moved into slot 123 and the paper advance motor rotating all four rollers in the forward direction 313. Once the paper has been advanced to the turn roller 322, the carriage 200 can be moved to the right, pushing the cam assembly 110, thus moving the selector pin 142 to stop position 115. During carriage motion (e.g. during printing of a swath) the feed roller 312 is stopped. If the feed roller 312 remains stopped as the carriage moves back to the left, selector pin 142 will be released back to slot 122 into the printing position. When it is desired to pick the next sheet, the carriage 200 moves to the right, pushing the cam assembly 110 and releasing it while the feed roller 312 moves forward, so that selector pin 142 moves into slot 124 to enable the pick forward mode for picking the next sheet. Since in this tailgating sequence it is never required to move the feed roller 312 backwards, it is evident that the picking operation can be activated or deactivated at any point during printing. Thus a sheet can be picked immediately after the previous one, with no gaps between the two sheets. The timing of switching modes by actuating selector assembly 100 can be adjusted depending upon the length of the sheets of media.

Figure 6:
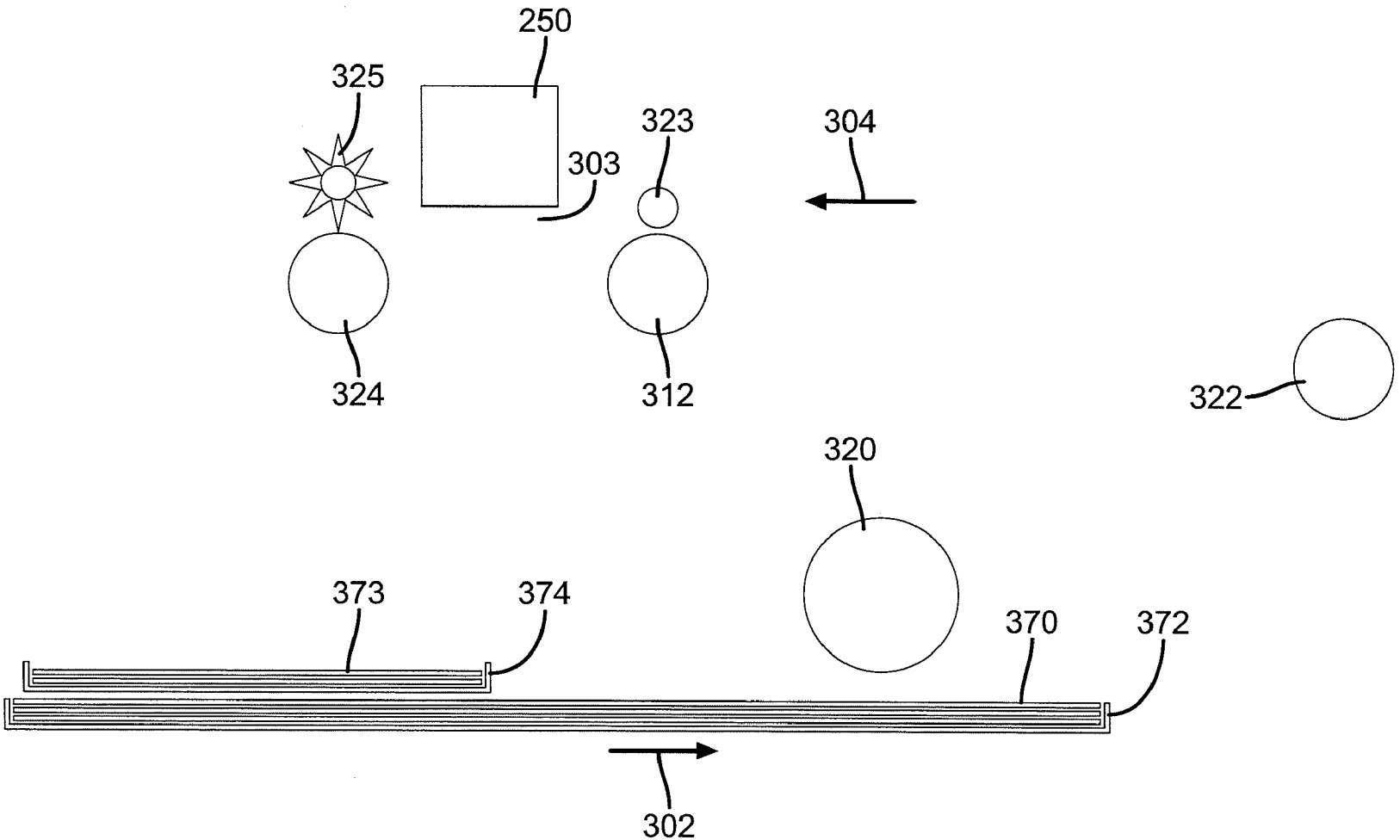
FIG. 6 is a schematic side view showing a photo paper tray in its forward position.
Figure 7:
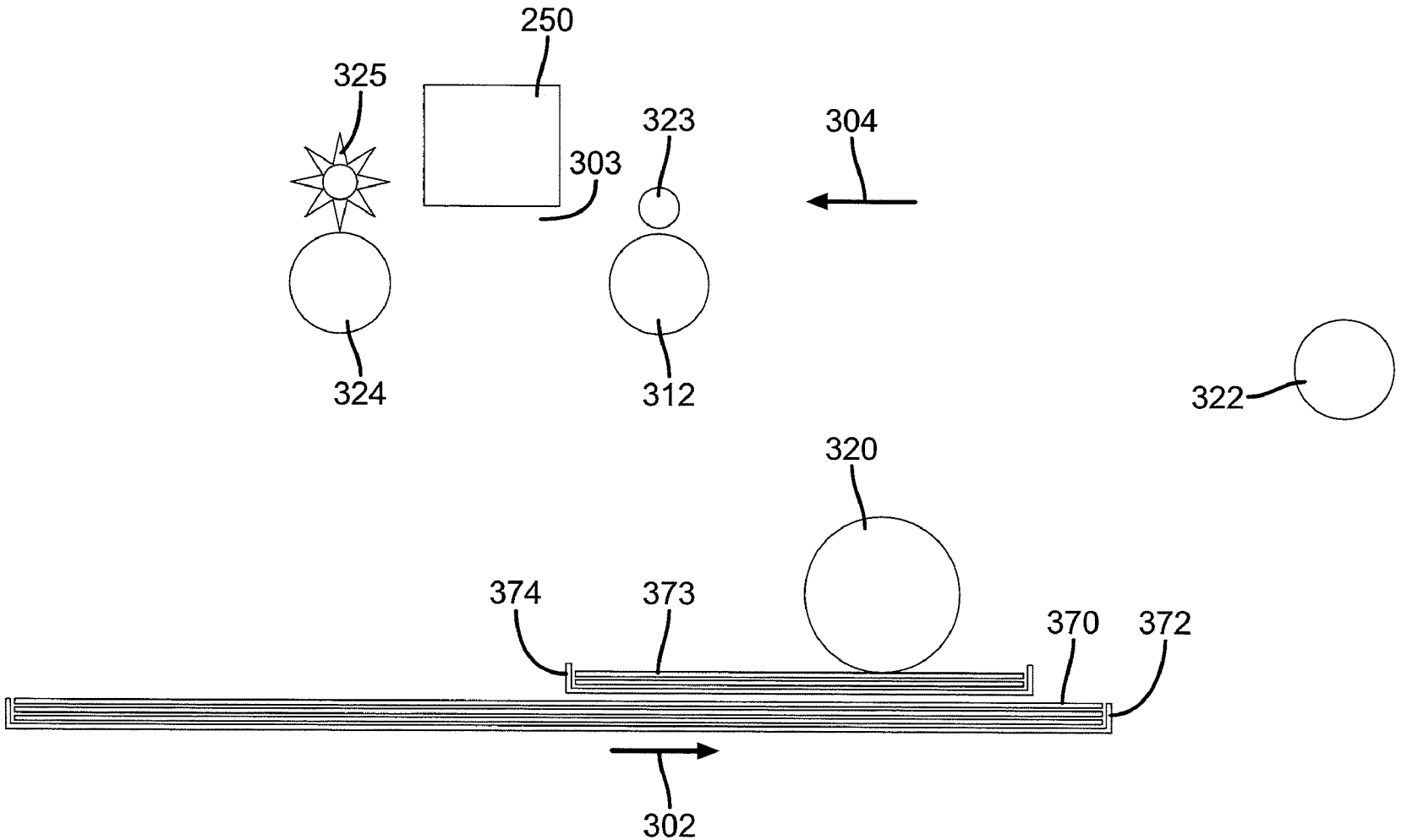
FIG. 7 is a schematic side view showing a photo paper tray in its printing position.

A third function which can be optionally selected is photo tray movement, for example when selector pin 142 is positioned in slot 123. In one embodiment, in this position an arm 146 of selector pin assembly 140 causes a gear to engage with a rack (not shown) that can move a photo paper tray back and forth depending on the direction of motor rotation, as in FIGS. 6 and 7. In both figures there is a paper stack 370 in main paper tray 372 and there is a stack of photo paper 373 in photo paper tray 374. The sheets in paper stack 370 are of a larger size (for example, 8.5"×11") compared to the sheets in paper stack 373 (for example, 4"×6"), and photo paper tray 374 is not as long as main paper tray 372. In FIG. 6, the photo paper tray 374 has been moved to its forward position, for example by rotating the paper advance motor in a first direction such that the gear and the rack cause the tray to move forward. In this position, the pick roller 320 is able to contact the top sheet in paper stack 370 in the main tray 372. Also in the forward position of the photo paper tray 374, additional photo paper 373 may be loaded. In FIG. 7, the photo tray 374 has been moved along direction 302 to its printing position, for example by rotating the paper advance motor in a second direction that is opposite the first direction. In the printing position of the photo paper tray 374, the pickup roller 320 is able to contact the top sheet in photo paper stack 373. In some embodiments the pickup roller is mounted on a pivotable pick arm which is able to be moved up or down to rest on the top sheet of whichever tray is beneath it.

While the embodiments above described a particular group of functions that may be enabled by selector assembly 100, various other functions may be enabled in other embodiments. These may include other functions that require motion, such as the maintenance functions of capping, wiping or pumping.

Figure 8:
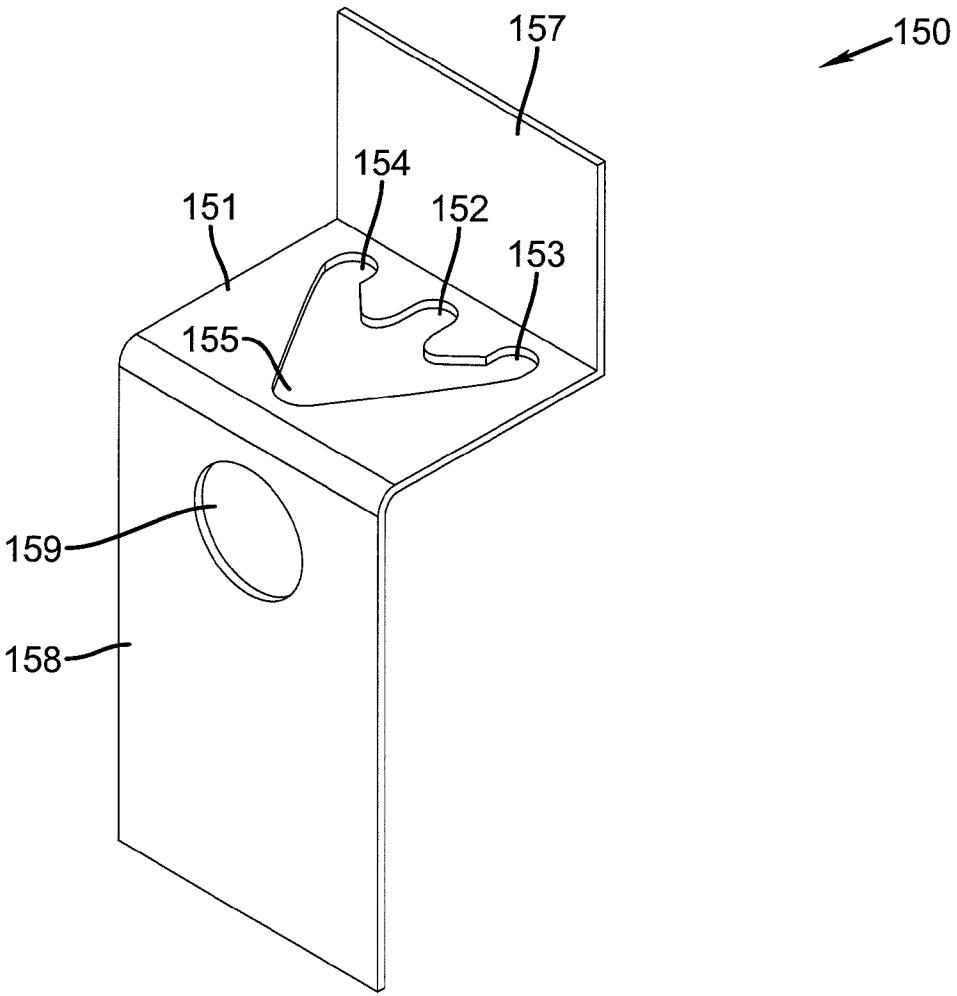
FIG. 8 is a perspective view of a second embodiment of the cam member assembly.

Selector assembly 100 may be made in other ways than the coaxially mounted cam assembly 110, spring 130 and selector pin assembly 140. A second embodiment of a selector assembly is shown in FIG. 8. In this second embodiment, the functions of the cam assembly 110 and the spring 130 are incorporated together as leaf spring cam assembly 150. Leaf spring cam assembly 150 consists of bent thin strip of metal or plastic, for example, and includes a cam member portion 151 with slots 152, 153 and 154 and a stop position 155; a pushing portion 157; and a mounting portion 158 with a hole 159. Leaf spring cam assembly 150 may be made by standard metal or plastic forming processes. Leaf spring cam assembly 150 operates in much the same way as was described above for the cam assembly 110, and cam member portion 151 has cam paths similar to those in cam member 111. A selector pin assembly 140 of the same or similar design to that described above operates in conjunction with leaf spring cam assembly 150. Feed roller shaft 319 passes through hole 159 in mounting portion 158. Cam member portion 151 cantilevers over selector pin assembly 140 such that selector pin 142 is captured within the open slotted region. The mounting portion 158 is constrained translationally on feed roller shaft 319, so that in its normal position, cam member portion 151 is located such that selector pin 142 will be positioned in one of the slots 152, 153 or 154. In order to release the pin from one of the slots, the carriage 200 pushes the pushing portion 157, causing the leaf spring cam assembly to bend, and allowing the cam member portion 151 to move parallel to the axis of the feed roller shaft 319 in a direction that locates the stop position 155 at the selector pin 142. When the carriage 200 moves away, the restoring force of the leaf spring cam assembly 150 causes it to assume its normal configuration, and selector pin 142 will be located in slot 152, 153 or 154, depending on whether and which way the feed roller 312 turned as the carriage 200 released the pushing portion 157.

The invention has been described in detail with particular reference to certain preferred embodiments thereof, but it will be understood that variations and modifications can be effected within the scope of the invention.

PARTS LIST

100 Selector assembly
110 Cam member assembly
111 Cam member
112 First cam path
113 Second cam path
114 Third cam path
115 Stop position
116 Sleeve
117 Pushing feature
118 Flange
122 First slot
123 Second slot
124 Third slot
130 Spring
140 Selector pin assembly
142 Selector pin
144 Friction mount sleeve
146 Arm
148 Friction mount slots
150 Leaf spring cam assembly
151 Cam member portion
152 First slot
153 Second slot
154 Third slot
155 Stop position
157 Pushing portion
158 Mounting portion
159 Hole
200 Carriage
250 Printhead chassis
262 Multichamber ink supply
264 Single chamber ink supply
300 Printer chassis
302 Paper load entry
303 Print region
304 Paper exit
306 Right side of printer chassis
307 Left side of printer chassis
308 Front of printer chassis
309 Rear of printer chassis
310 Hole for paper advance motor drive gear
311 Feed roller gear
312 Feed roller
313 Forward rotation of feed roller
319 Feed roller shaft
320 Pickup roller
322 Turn roller
323 Idler roller
324 Discharge roller
325 Star wheel
330 Maintenance station
370 Stack of media
371 Top sheet
372 Main paper tray
373 Photo paper stack
374 Photo paper tray

380 Carriage motor
382 Carriage rail
384 Belt
390 Printer electronics board
392 Cable connectors

The invention claimed is:

1. A printer comprising:

a media feed roller;

a selector pin assembly comprising:

a sleeve that is friction mounted on the feed roller; and a selector pin extending from the friction mount sleeve so that select rotations of the media feed roller cause the selector pin to rotate;

a cam member including a plurality of paths, each path corresponding to a printer function, the cam member and the selector pin being configured to provide relative movement of the selector pin through the plurality of paths, the location of the selector pin in one of the plurality of paths enabling the corresponding printer function.

2. The printer of claim 1, further comprising:

a motor connected to the media feed roller, the media feed roller being driven by the motor, the selector pin and the cam member being positioned about the media feed roller, wherein relative movement of the selector pin through the plurality of paths of the cam member is accomplished when the media feed roller is driven by the motor.

3. The printer of claim 1, further comprising:

a clutch mechanism, wherein the selector pin is associated with the media feed roller through the clutch mechanism.

4. The printer of claim 1, the media feed roller having an axis of rotation, further comprising:

a printhead carriage moveable in a direction parallel to the axis of rotation of the media feed roller, the cam member being spring loaded along the axis of the media feed roller and engageable with the printhead carriage, wherein engagement of the printhead carriage with the cam member moves the cam member along the axis of rotation of the feed roller to cause the selector pin to move from one of the plurality of paths to an intermediate location of the cam member which permits movement of the selector pin to another of the plurality of paths of the cam member.

5. The printer of claim 4, wherein the intermediate location of the cam member includes a stop position for the selector pin.

6. The printer of claim 4, wherein the intermediate location is located at the intersection of the plurality of paths.

7. The printer of claim 1, further comprising:

a media feed roller including a shaft; and a printhead carriage moveable in a direction parallel to the shaft of the media feed roller, the cam member being spring loaded along the shaft of the media feed roller and engageable with the printhead carriage, wherein engagement and disengagement of the printhead carriage with the cam member moves the cam member to cause the selector pin to move from one of the plurality of paths to another of the plurality of paths.

8. The printer of claim 7, wherein the cam member being spring loaded along the shaft of the media feed roller includes one of (a) the cam member being a portion of a leaf spring and (b) the cam member and a compression spring both being mounted along the shaft of the media feed roller.

9. The printer of claim 1, wherein the plurality of paths includes three paths.

10. The printer of claim 1, further comprising:

an arm connected to the selector pin, wherein movement of the selector pin through the plurality of paths changes the position of the arm to enable corresponding printer function.

* * * * *